US005325992A

United States Patent [19]

Koller et al.

[11] Patent Number: 5,325,992

[45] Date of Patent: Jul. 5, 1994

[54] BAG DISPENSER

[75] Inventors: Josef Koller, Neuenkirch; Rudolf Schmid, Zofingen, both of Switzerland

[73] Assignee: Folag AG Folienwerke, Sempach-Station, Switzerland

[21] Appl. No.: 92,945

[22] PCT Filed: Feb. 7, 1991

[86] PCT No.: PCT/CH91/00031

§ 371 Date: Dec. 10, 1991

§ 102(e) Date: Dec. 10, 1991

[87] PCT Pub. No.: WO91/11942

PCT Pub. Date: Aug. 22, 1991

Related U.S. Application Data

[63] Continuation of Ser. No. 834,320, Dec. 10, 1991, abandoned.

[30] Foreign Application Priority Data

Feb. 13, 1990 [CH] Switzerland ..... 457/90

[51] Int. Cl.[5] ..... B65H 1/00

[52] U.S. Cl. ..... 221/63; 221/33; 225/106

[58] Field of Search ..... 225/14, 15, 106; 242/55.2, 55.53; 221/33, 63, 26, 28, 29

[56] References Cited

U.S. PATENT DOCUMENTS 4,648,530 3/1987 Granger ..... 221/63
4,793,539 12/1988 Haenni et al. ..... 221/63
4,846,415 7/1989 Jertberg et al. ..... 225/106
4,930,385 6/1990 Sonoco .

FOREIGN PATENT DOCUMENTS 0109343 5/1984 European Pat. Off. .
1124769 3/1966 United Kingdom .
2025366 1/1980 United Kingdom ..... 225/106

*Primary Examiner*—H. Grant Skaggs
*Attorney, Agent, or Firm*—Wegner, Cantor, Mueller & Player

[57] ABSTRACT

A dispensing device including a container for a supply of items forming a web. The dispensing device includes a recess formed in an outer wall of the container, a braking unit overlapping the recess. The braking unit includes two lips which work together when items are dispensed and a linear slit between the two lips which enables the items to pass between the two lips, the two lips being fitted with bristles which constitute active elements of the two lips, unattached ends of the bristles of one of the lips extend into, and mesh with, an area of unattached ends of the bristles of the opposite lip. The items are camisole-shaped and sequentially joined bags having a body with a bottom part and handles at the upper part. The bottom part of the body of one of the bags is connected to the leading edge of the handles of the next bag. A nozzle for dispensing the bags is connected to the recess, the nozzle including a hollow cover in the base of which there is an oblong and virtually linear opening, the distance between the edges of the opening being considerably larger than the thickness of a bag. The braking unit is attached to the hollow cover in such a way that it overlaps the linear opening in the hollow cover.

13 Claims, 3 Drawing Sheets

BAG DISPENSER

This application is a continuation of U.S. application Ser. No. 07/834,320 filed Dec. 10, 1991 now abandoned.

The present invention relates to a bag dispensing device comprising a container with a supply of bags and a nozzle in one of the walls of the container. The bags can leave the container via this nozzle.

A dispensing device of this generic type is already known in the art. The nozzle of this appliance has flexible and opposing elements, which are pressed against each other. The bags must pass between these elements as they leave the container. The nozzle is essentially round and, as the bags go through this nozzle, they are compressed into the form of a rope, which facilitates the separation of the respective bag from the supply of bags. It has turned out, amongst other things, to be extremely tedious to introduce bags from a new supply pack into a nozzle of this kind.

The object of the present invention is to eliminate this and other disadvantages of the state of the art.

According to the invention, the stated object is achieved with the device of the generic type mentioned in the introduction defined as a bag dispenser comprising a container (1) containing a supply (6) of bags (7) and nozzle (10) in one of the walls (3) of the container. The bags can leave the container via this nozzle (10). The nozzle (10) has a linear slit defined by braking lips (16, 17). At least one of the lips (16, 17) is fitted with braking elements (20) virtually parallel to each other and at right angles to the longitudinal axis of the slit.

Further details of designs for the present invention are given below, with accompanying drawings.

Figure 1:
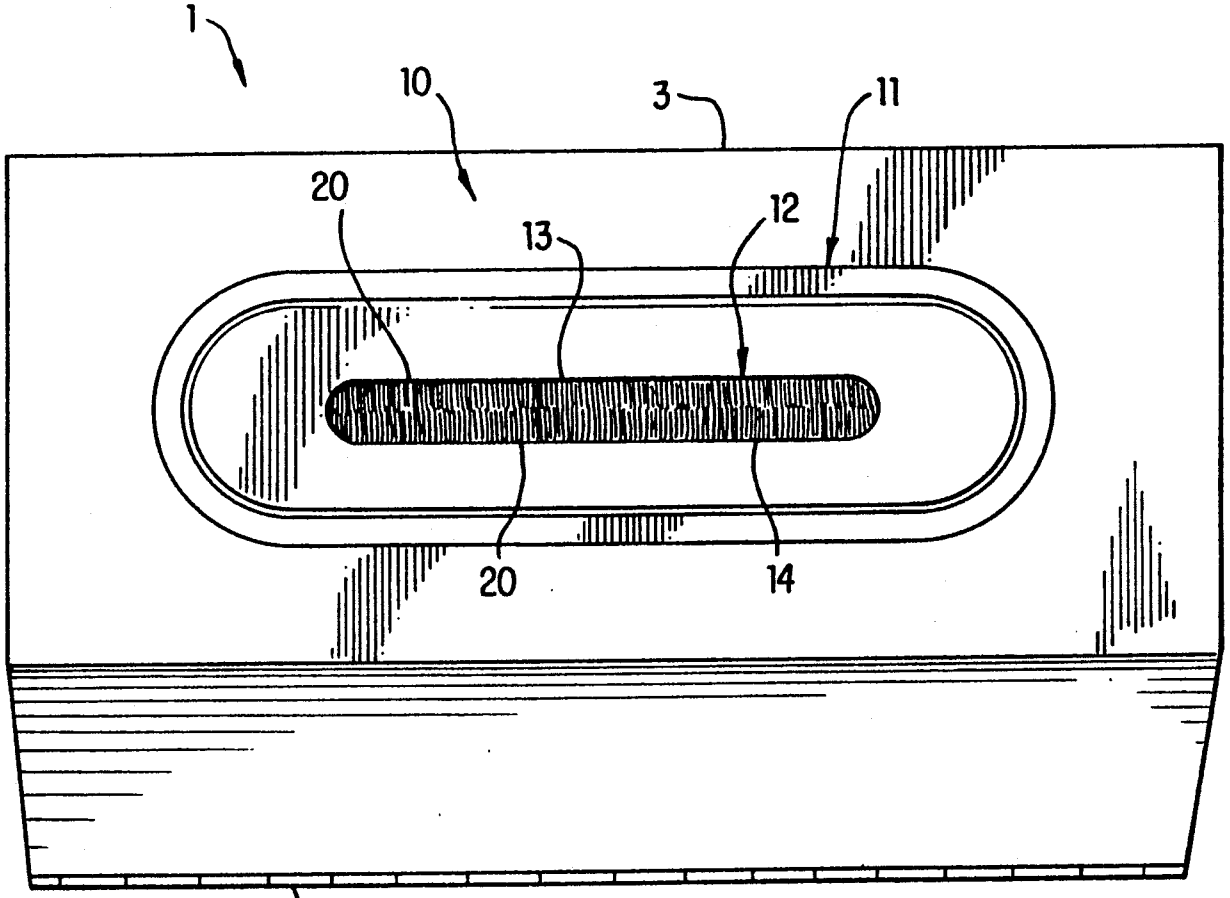
FIG. 1 is a view from the front, showing the present dispenser with a dispensing nozzle.
Figure 2:
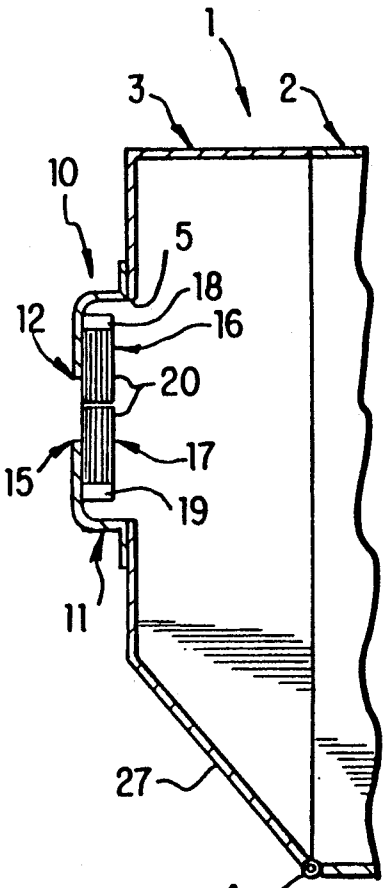
FIG. 2 shows a vertical section through the part of the device according to FIG. 1, which surrounds the nozzle.

The present dispensing device comprises a container (1), which has a front wall (3) and a basic frame (2), which can, for example, be fixed onto a wall. The front wall (3) is attached to the container frame by means of a hinge, which allows it to be tilted. There is a recess (5) in the front wall (3), to which a dispensing nozzle (10) is assigned. The bags can leave the container (1) via this nozzle (10). The nozzle (10) is assigned in such a way that the nozzle (10) overlaps the recess (5) on the outside.

Figure 3:
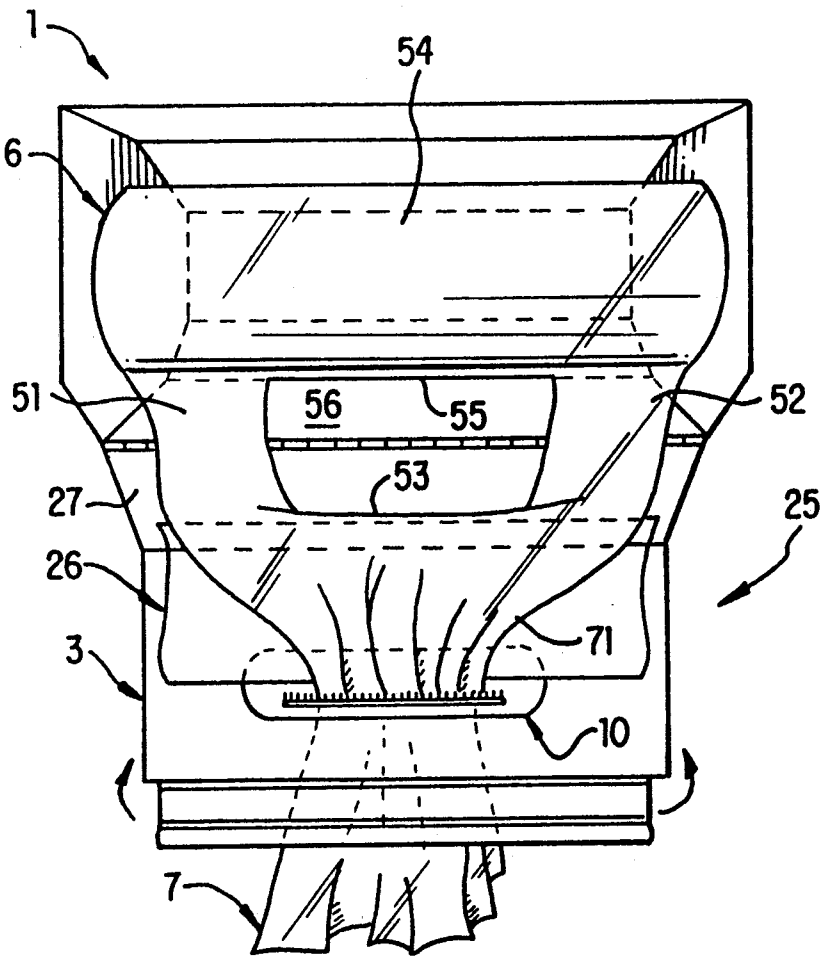
FIG. 3 is a view from the front, showing the present device with its braking device for the dispensed bags.

Inside the container (1) there is a stock (6) of bags (7) (FIG. 3). The bags (7) in the supply (6) can be in the form of a roll or can be stacked in zig-zag fashion or other similar form. The bag (7) uppermost in the stock (6) is introduced through the opening in the nozzle (10) and, on the outer side of the front wall (3), it can be torn from the next bag (7) of the supply (6).

The cut-out free space section 56 defines the handles of the plastic bag which form the metaphorical shoulder straps of the "camisole-shaped" bag. The front ends of the handles 51 and 52 of the following "camisole-shaped" bag 71 are attached to the bottom edge 53 of the body of the leading camisole-shaped bag 7. Margin 55 of the hollow bag body 54 extends between the handles 51 and 52 of the bag 71 so that there exists a free space cut-out delineated by the handles 51 and 52, the bottom edge 53 of bag 7, and the margin 55 of the bag body 54. When the leading bag 7 is pulled out of the container nozzle 10, the bottom edge 53 of the leading bag 7 passes the lips of the nozzle 10 and pulls the front parts of the handles 51 and 52 out of the container. When the margin 55 reaches the lips of the nozzle 10, the bristles which overlap one another stop said top margin 55 of the following bag 71 at the location of the nozzle 10. Now, it is easy to tear the leading bag 7 from the following bag 71 because the material cohesive force with which the front parts of the handles 51 and 52 are attached to the bottom edge 53 of the leading bag 7 is less than the resistive force exerted by the lips of nozzle 10 on the margin 55. After the leading bag 7 is torn away from the supply 6, the handles 51 and 52 of the following bag 71 remain extended out from the container because the margin 55 remains located at the position of the lips of the nozzle 10. Now, one can readily grasp handles 51 and 52 in order to pull out the following bag 71. Then, one can readily pull on the handles 51 and 52 in the described manner and the following bag 71 can be severed from the next bag, and so on.

The nozzle (10) is constructed as an independent unit which can be attached to the front wall (3). The nozzle (10) has a hollow, saucer-shaped cover (11), in the base of which there is an oblong and virtually linear opening (12). The distance between the edges (13 and 14) of this opening (12) is considerably larger than the thickness of the bags. The edges (13 and 14) of the orifice (12) are virtually parallel to one another.

A braking unit (15) is assigned to the cover opening (12) in such a way that the unit (15) is attached to the inside of the cover (11). The braking unit (15) comprises two sections or lips (16 and 17) respectively, which work together when bags (7) are dispensed. Each of these lips (16 and 17 respectively) has elements (20) which run virtually parallel to one another and at right angles to the longitudinal axis of the opening (12). These elements are held by one end in a mounting (18 and 19 respectively). The other ends of these elements (20) move freely.

The lips (16 and 17) of the braking unit (15) are assigned in such a way that the mountings (18 and 19) are situated on the outer side and the unattached ends of the braking elements (20) are in the centre of the braking unit (15). The distance between the lips (16 and 17) is calculated so that the unattached ends of the braking elements (20) are a small distance apart or so that they actually touch each other. The lips (16 and 17) can, however, be assigned so that the unattached ends of the braking elements (20) of one lip (16 or 17 respectively) extend into the area of the unattached ends of the braking element (20) of the opposite lip (17 or 16 respectively).

The slit, which enables the bags (7) to pass between the lips (16 and 17), is linear and it is shorter in length than the width of the bags (7) in the supply pack (6).

The lips (16 and 17) can be fitted with a type of bristle, wherein the bristles constitute the active element of the lips (16 and 17). The one end of each bristle is held in the mountings (18 and 19). The active elements of the lips (16 and 17) can, however, also be made of strips of flexible material such as rubber or a synthetic. The dimensions and/or the number of braking elements (20) in the respective lip (16 and 17) depend on the rigidity of the braking element (20) and on the extent of the force required to tear off the first bag (7). It is understood that the construction of the lips (16 and 17) of a braking unit (15) need not be identical.

The fundamental advantage of the present dispensing device is the fact that, when the first bag of a new supply needs to be inserted, the flexible braking elements (20), which can be 10 mm to 20 mm in length for example, allow the person operating the device to put their fingers through the nozzle (10) and thereby insert the bag into the nozzle (10) without difficulty.

Figure 4:
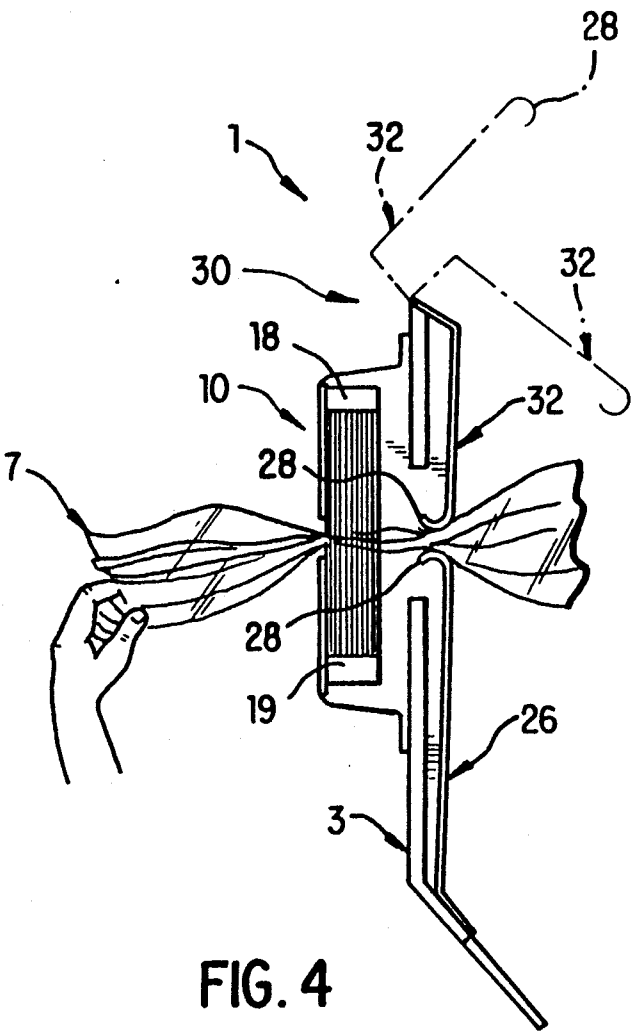
FIG. 4 shows a vertical section of the part of the present device which surrounds the dispensing nozzle, wherein this device displays a second embodiment possibility for the braking device.

The present appliance has a device (25), which also acts as a brake on the strip of bags when a bag is to be torn from this strip. This braking device (25) is located inside the housing (1) and is assigned to the inner side of the nozzle (10). FIG. 3 shows an initial design for this braking device (25). It has a strip (26) made of steel, for example. One of the longitudinal edges of this strip (26) is attached to the inner side of the front wall (3). This strip edge is advantageously attached to the oblique section (27) of the front wall (3), beneath the dispenser nozzle (10). The opposite, unattached longitudinal edge (28) of the strip (26) is rounded from the inside to the outside, as depicted in FIG. 4. The bags (7) are fed via this rounded edge (28) to the nozzle (10).

The gliding plane of the rounded edge (28) is opposite but out-of-line with the slot in the nozzle (10). This misalignment is such that the unattached longitudinal edge of the material strip (26) covers the slit or slot respectively in the nozzle (10). The respective bag (7), which is to go through the nozzle (10), is therefore led over the rounded edge (28). As the bag is led over the edge (28), the distortion of the bag (7) acts as the brake needed to tear the foremost bag from the remaining bags and adequately fulfils this requirement. A braking device (25) of this type is extremely simple and effective. Inserting the first bags from a new supply into the slit in the nozzle (10) does not create any problems worth mentioning because it is simple to guide the first bag over the rounded edge (28), downwards for example, and to insert it into the nozzle (10).

If the intensity of the brake effect on the strip of bags has to be adjusted, a braking device can be used, as depicted in FIG. 4. This braking device (30) includes, amongst other things, the previously mentioned fixed braking strip (26), which again is attached beneath the nozzle (10). This braking device (30) also has a second strip of material, assigned above the nozzle (10). The strip edge facing away from the nozzle is attached to the container (1) by a hinge, as shown by the three individual positions of same in FIG. 4. The edge section of the movable strip (32) near the nozzle (10) has a rounded edge (28) as well.

The rounded edges (28) go from the inside to the outside so that the bags can slide over them unhindered and without being damaged. There is a slit between the edges (28) of the braking elements (26 and 32), through which the bags must pass as they leave the container. The width of this slit depends on the required braking effect on the bags (7). For this purpose, at least one of the braking elements (26 or 32 respectively) can be attached to the housing (1) in such a way that it can be adjusted and set.

On this device (30), the slit between the braking edges (28) is aligned with the slit in the nozzle (10) because the braking effect results from the interaction of the two braking edges (28). The access flaps on the upper braking element (32) make it possible to insert the first bag (7) of a supply (6) into the nozzle quickly and easily. When the bag has been inserted, the upper braking element (32) is swung back into position and the dispenser is ready for use again.

Figure 5:
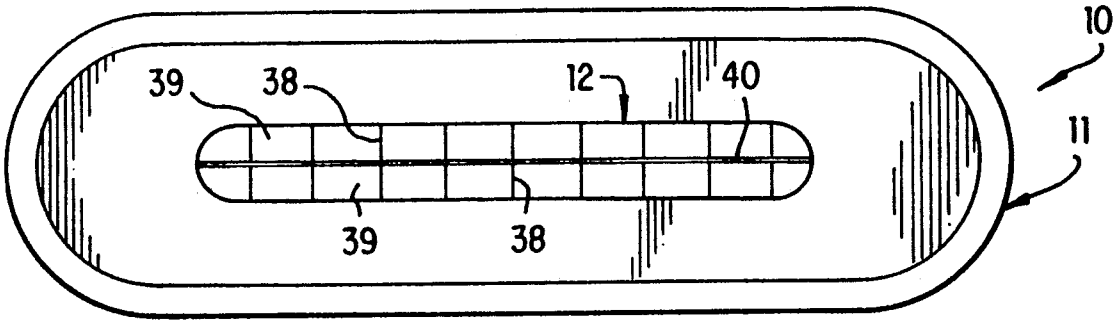
FIG. 5 is a view from the front, showing a second embodiment possibility for the lips of the braking unit on the nozzle, according to FIG. 1
Figure 6:
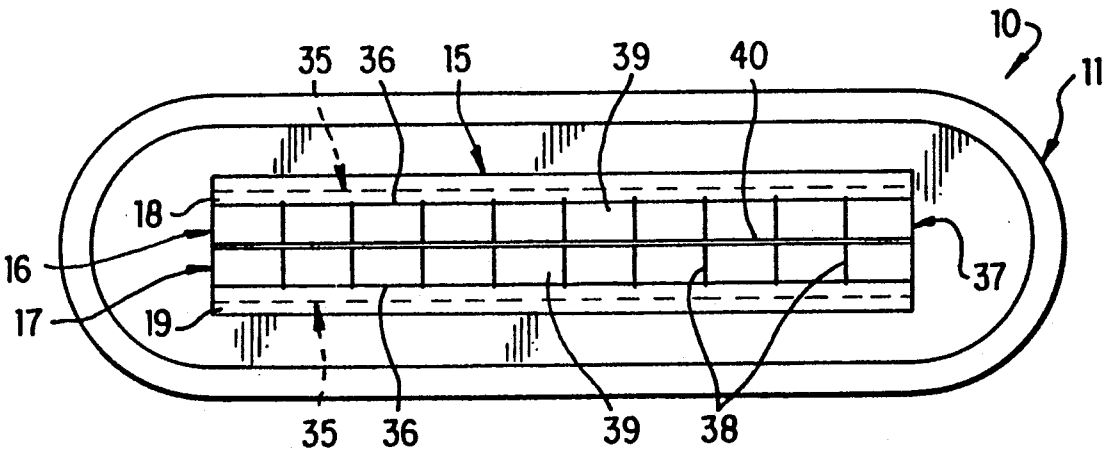
FIG. 6 is a rear view of the lips according to FIG. 5.

FIG. 5 is a front view of a second design possibility for the lips (16 and 17) of a braking unit (15) of the nozzle (10) according to FIG. 1. FIG. 6 shows this braking unit (15) from the rear. The lips (16 and 17) of this braking unit (15) comprise at least a strip (35) of flexible material such as rubber or synthetic. One of the longitudinal edges (36) of this strip (35) is held in the mounting (18 or 19 respectively). There are notches in the remaining part (37) of the strip (35), i.e., the part (37), which juts out of the mounting (18 or 19 respectively). These notches (38) run vertically to the slit (40) between the front part of the lips (16 and 17). Fingers (39), which move independently of each other, are separated from each other by the notches (38).

The surface area of the respective finger (39) resting on the strip of bags (7) can also be influenced by the thickness of the strip (35). If required, several strips (35) can be fixed into the mourning (18 or 19 respectively) one on top of the other or one behind the other so that there are several rows of fingers (39) behind one another in the mounting (18 or 19 respectively). The direction of these fingers (39) coincides with the direction in which the strip of bags moves.

We claim:

1. A dispensing device comprising a container for a supply of items forming a web, said device comprising:
   - a recess formed in an outer wall of the container, and
   - a braking unit overlapping the recess,
   - wherein the braking unit further comprises two lips which work together when items are dispensed, and
   - a linear slit between the two lips which enables the items to pass between the two lips,
   - the two lips being fitted with bristles which constitute active elements of the two lips,
   - unattached ends of the bristles of one of the lips extend into, and mesh with, an area of unattached ends of the bristles of the opposite lip,
   - wherein the items are camisole-shaped and sequentially joined bags having a body with a bottom part and handles at the upper part, whereby the bottom part of the body of one of the bags is connected to the leading edge of the handles of the next bag,
   - wherein a nozzle for dispensing the bags is connected to the recess, the nozzle comprising a hollow cover in the base of which there is an oblong and virtually linear opening, the distance between the edges of the opening being considerably larger than the thickness of a bag, and
   - wherein the braking unit is attached to the hollow cover in such a way that it overlaps the linear opening in the hollow cover.

2. The dispensing device of claim 1 wherein the length of the slit between the two lips is shorter than the width of the bags in the supply pack or web.

3. The dispensing device of claim 1 wherein the braking unit is attached to the inside of the hollow cover.

4. The dispensing device of claim 1 wherein each of the two lips further comprises a mounting in which one end of the bristles of each lip are held.

5. The dispensing device of claim 1 wherein the outer wall of the container is a front wall thereof.

6. A dispensing device comprising, a container for a supply of items forming a web, said device comprising:

a recess formed in an outer wall of the container, a braking unit overlapping the recess, the braking unit comprising two lips which work together when items are dispensed, a linear slit between the two lips which enables the items to pass between the two lips, each of the two lips further comprising at least one braking element of flexible material, one end of each of the at least one braking element being held in a mounting, whereas the other end of the at least one braking element moves freely, notches arranged transversely of the slit formed in the other end of the at least one braking element so that the at least one braking element has fingers separated by the notches, and wherein the items are camisole-shaped and sequentially joined bags having a body with a bottom part and handles at the upper part, whereby the bottom part of the body of one of the bags is connected to the leading edge of the handles of the next bag.

7. The dispensing device of claim 6 wherein each of the at least one braking element of flexible material further comprises several strips fixed into a mounting, one behind the other, so that there are several rows of fingers behind one another in the mounting.

8. The dispensing device of claim 7 wherein the distance between the two lips is calculated so that the unattached other ends of the corresponding at least one braking elements are no more than a small distance apart from each other.

9. A bag dispenser comprising, a container containing a supply of bags, and a nozzle located in a wall of the container, wherein the bags can leave the container via the nozzle, wherein the nozzle has a linear slit defined by braking lips, wherein at least one of the braking lips is fitted with braking elements substantially parallel to each other and at right angles to a longitudinal axis of the linear slit, and wherein a braking device is located inside the nozzle and acts as a brake on the bags as they leave the container, wherein the braking device further comprises a strip made out of a rigid material, and wherein a longitudinal edge of the strip is attached to the inside of a front wall of the container and wherein an opposite, unattached longitudinal edge of the strip is rounded from the inside to the outside.

10. The bag dispenser of claim 9 wherein a gliding plane defined by the unattached longitudinal edge curves from the inside to the outside and toward the nozzle.

11. The bag dispenser of claim 9 wherein the rounded edge is located opposite, but out-of-line with, the linear slit in such a way that the rounded edge on the corresponding support covers the linear slit defined by the braking lips.

12. A bag dispenser comprising, a container containing a supply of bags, and a nozzle located in a wall of the container, wherein the bags can leave the container via the nozzle, wherein the nozzle has a linear slit defined by braking lips, wherein at least one of the braking lips is fitted with braking elements substantially parallel to each other and at right angles to a longitudinal axis of the linear slit, and wherein a braking device is located inside the nozzle and acts as a brake on the bags as they leave the container, wherein the braking device has two rounded edges, wherein one of these edges forms a first support fixed inside the container and wherein the other edge forms a second support which is attached to the container by means of a hinge and which can be moved away from the first support.

13. The bag dispenser of claim 12 wherein there is a slit between the two rounded edges, via which the bags can leave the container, and wherein the slit between the two rounded edges is aligned with the linear slit defined by the braking lips.

* * * * *